US005547062A

United States Patent [19]

Mays et al.

[11] Patent Number: 5,547,062

[45] Date of Patent: Aug. 20, 1996

[54] UNIVERSAL CURRENCY ACCEPTOR

[75] Inventors: David S. Mays; Robert E. Blevins, both of Mentor, Ohio

[73] Assignee: Diversified Technologies, Inc., Blue Bell, Pa.

[21] Appl. No.: 454,997

[22] Filed: May 31, 1995

[51] Int. Cl.[6] ..... G07D 11/00; B65H 9/04

[52] U.S. Cl. ..... 194/206; 194/344; 271/240

[58] Field of Search ..... 194/205, 206, 194/207, 344, 350, 351; 193/46; 271/240; 902/17

[56] References Cited

U.S. PATENT DOCUMENTS

| | | | |
|---|---|---|---|
| 4,504,052 | 3/1985 | Murck et al. | 271/9 |
| 4,834,230 | 5/1989 | Kondo et al. | 194/206 |
| 5,290,033 | 3/1994 | Bittner et al. | 194/206 X |
| 5,344,135 | 9/1994 | Isobe et al. | 271/180 |
| 5,372,361 | 12/1994 | Isobe et al. | 271/181 |

FOREIGN PATENT DOCUMENTS

| | | | |
|---|---|---|---|
| 099324 | 1/1984 | European Pat. Off. | 194/206 |
| 3240761 | 3/1984 | Germany | 194/207 |
| 3196390 | 8/1991 | Japan | 194/206 |
| 4-1885 | 1/1992 | Japan | 194/206 |
| 0628170 | 2/1982 | Switzerland | 194/344 |

*Primary Examiner*—David A. Bucci
*Assistant Examiner*—Scott L. Lowe
*Attorney, Agent, or Firm*—Caesar, Rivise, Bernstein, Cohen & Pokotilow, Ltd.

[57] ABSTRACT

A note acceptor for validating a paper currency note introduced therein. The acceptor includes a note validator unit and plural, interchangeable nose-pieces for releasable mounting on the validator unit. The validator unit includes a housing having a path extending through it, a conveyor for moving a paper currency note along the path, and plural optical and magnetic sensors to sense features of the note conveyed along the path. The path is of a width sufficient to accommodate the widest of any paper currency note to be validated. Each nose-piece forms a respective entrance port and note-guide to the path in the validator by defining a channel of a predetermined width corresponding to the width of an associated sized paper currency note. By mounting a nose-piece designed for a particular sized paper currency onto the validator housing, the resulting acceptor is configured to handle that size paper currency. When the nose piece is removed the validator is arranged to accept the largest size currency note.

7 Claims, 4 Drawing Sheets

UNIVERSAL CURRENCY ACCEPTOR

BACKGROUND OF THE INVENTION

This invention relates generally to currency acceptors for validating paper money, and particularly to currency acceptors which can be readily configured to accept various sized paper currency without any loss of accuracy in the validation process caused by misalignment of the currency in the acceptor.

Paper bill or currency acceptors are commonly found in gaming or vending apparatus in order to receive paper money, to validate it and then provide a signal to the associated equipment, e.g., a slot machine (in the case of the gaming industry), a non-alcoholic beverage vending machine (in the case of the vending industry), etc. Examples of commercially available bill or currency acceptors are shown in the following U.S. Pat. Nos.: 4,834,230 (Kondo), 5,344,135 (Isobe et al.), and 5,372,361 (Isobe et al.).

As is known each of the devices shown in these patents and other commercially available currency validators typically include a path of a predetermined width through which the paper bill or note is carried by some carrier means, e.g., plural conveyor belts. A plurality of optical and magnetic sensors are mounted adjacent the path to sense various portions of the bill as it passes thereby, and to provide electrical signals responsive thereto to an associated microprocessor or control means (usually forming a portion of the validator or, in some cases, forming a portion of the apparatus to which the validator is connected) to determine if the bill is valid, and its denomination. If the bill is genuine the currency validator provides an output signal to the associated apparatus indicating that fact and the bill is transported to some receptacle within the apparatus. If the bill is determined not to be valid it is rejected or expelled out of the validator.

As will be appreciated by those skilled in the art, the positioning of the bill within the path is somewhat critical to ensure that a good reading of the bill by the sensors can be achieved. Thus, if the bill is off position, e.g., not centrally located in the path, or skewed, the likelihood of a misread is increased.

While the prior art bill acceptor devices are suitable for their intended purposes they are of somewhat limited applicability due to the need to provide an optimized bill reading path for the specific currency for which they are designed. In this regard each of the bill or currency acceptors of the prior art is designed or optimized to accept one country's currency or one size of currency to ensure that the bill is in the desired position and orientation with respect to the path when moved therethrough by the conveyor to ensure the accurate reading thereof. For applications involving United States currency, since all of the bill are of the same size, the prior art bill or currency acceptors typically are designed to provide a path whose width is just slightly greater than the width of U.S. currency bills. It necessarily follows that a currency acceptor designed for U.S. currency cannot be readily utilized for foreign applications wherein the bill(s) to be validated has(have) a greater or lesser width. To that end, for foreign applications a different size acceptor must be provided to accommodate the width of the bill(s) of the native currency.

A need thus exists for paper currency acceptor/validators which can be readily configured or modified to be utilized for various sized paper currencies.

OBJECTS OF THE INVENTION

Accordingly, it is a general object of this invention to provide a bill or currency acceptor device which overcomes the disadvantages of the prior art and addresses the above need.

It is another object of this invention to provide a bill or currency acceptor device which includes a bill validator unit and one or more interchangeable, releasably securable guide members for mounting to the bill validator unit to provide a bill acceptor device permitting any desired width currency note to be passed therethrough for validation.

It is still another object of this invention to provide one or more guide members which are simple in construction and arranged for ready mounting onto a bill or currency validator unit to provide a bill acceptor device permitting any desired width currency note to be passed therethrough for validation.

It is another object of this invention to provide one or more low cost guide members for mounting onto a bill or currency validator unit to provide a bill acceptor device permitting any desired width currency note to be passed therethrough for validation.

SUMMARY OF THE INVENTION

These and other objects of this invention are achieved by providing a note acceptor for validating a paper currency note introduced therein irrespective of the width of the note. The acceptor comprises a validator unit and first, interchangeable, entrance port means serving as a bill guide. The validator unit basically comprises a housing, note conveying means, and sensor means. The housing means establishes a path through the validator unit, with the path being of a width sufficient to accommodate the widest of the paper currency notes to be validated. The sensor means are disposed within the validator unit adjacent the path to sense a currency note provided along the path. The conveying means is disposed within the housing adjacent the path to convey a paper currency note along the path.

The first entrance port means is arranged to be releasably secured to said housing to form the entrance to the path. In particular, the first entrance port means defines a channel of a first predetermined width corresponding to the width of a first predetermined paper currency note. Thus, when the first predetermined paper currency note is inserted into the channel the channel guides the note to the conveying means, which in turn conveys the note down the path in a desired alignment and orientation, e.g., centered along the central longitudinal axis of the path, irrespective of the whether or not the note is as wide as the width of the path, so that the note can be accurately sensed to determine its validity/denomination.

In accordance with one preferred aspect of this invention the validator unit is arranged to have releasably secured thereto a second, interchangeable, entrance port means to replace the first entrance port means and thereby serve as the entrance to the path. The second entrance port means defines a channel of a second predetermined width corresponding to the width of a second predetermined paper currency note, with the second predetermined width being different than said first predetermined width. Accordingly, when the second predetermined paper currency note is inserted into the channel of the validator the channel guides the note to the conveying means, which in turn conveys the note down the path in the desired alignment and orientation for reading by the sensors, irrespective of the whether or not the note is as wide as the width of the path.

In accordance with another preferred aspect of this invention the entrance port means defines a plural channels, a first of said channels being of a first predetermined width corresponding to the width of a first predetermined paper currency note, and a second of the channels being of a second predetermined width corresponding to the width of a second predetermined currency note and which is narrower than the first predetermined currency note. Thus, this type of entrance port means can be used to accommodate two sizes of paper currency notes to ensure that each is guided in the desired alignment and orientation down the path for proper reading by the sensors.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
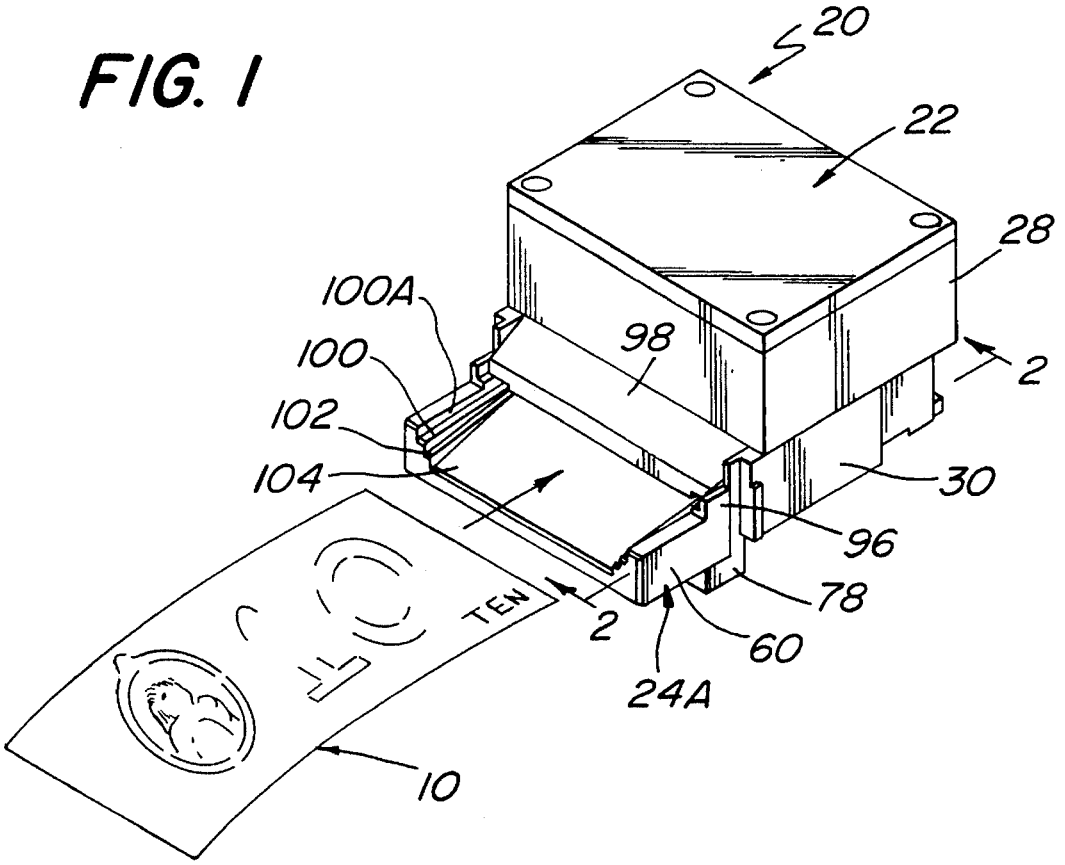
FIG. 1 is an isometric view of a paper bill or currency acceptor constructed in accordance with one embodiment of the subject invention.

Referring now to various figures of the drawings where like reference numerals refer to like parts there is shown at 20 in FIG. 1, an acceptor apparatus or device for validating a paper currency note 10 constructed in accordance with this invention. The acceptor apparatus basically comprises a validator unit 22 and at least one interchangeable entrance port or nose-piece 24A. The nose-piece 24A is arranged to be releasably secured to the validator unit 22 to serve as an entrance port and note guide for a path 26 (to be described later) through the validator unit 22 along which the paper currency note 10 will be conveyed for validation.

The paper currency note is conveyed through the path 26 in the unit 22 by a conveyor subassembly (to be described later) so that the note can be brought past plural sensors (also to be described later) for determining if the note is valid, e.g., genuine, and its denomination. The sensors are coupled to conventional electronic circuitry (not shown) including a microprocessor with associated computer programs stored in random access memory (RAM) and read-only memory (ROM) for accomplishing the bill validation procedure, for controlling the operation of the conveyor subassembly, and for providing signals to associated equipment, e.g., a slot machine (not shown) or vending machine (not shown), when the bill or note is determined to be valid. All of these validating functions are conventional in the art.

As will be described later each nose-piece of this invention serves to establish a channel of a predetermined width to accurately guide a paper currency note of that width to the path 26 so that the note is centered and properly oriented (i.e., not skewed) on the path, so that it can be accurately validated, even if the width of the note is less than the width of the path 26. This action ensures that the note can be readily validated using conventional techniques.

In accordance with a preferred aspect of this invention plural nose-pieces will be provided with the validator unit 22 so that that unit can be readily converted to accommodate different size paper currency notes, without having to change the validator unit itself. This conversion is readily accomplished by merely replacing one nose-piece with another of a different width channel and by an appropriate change in the note validating software resident in the apparatus.

Figure 5:
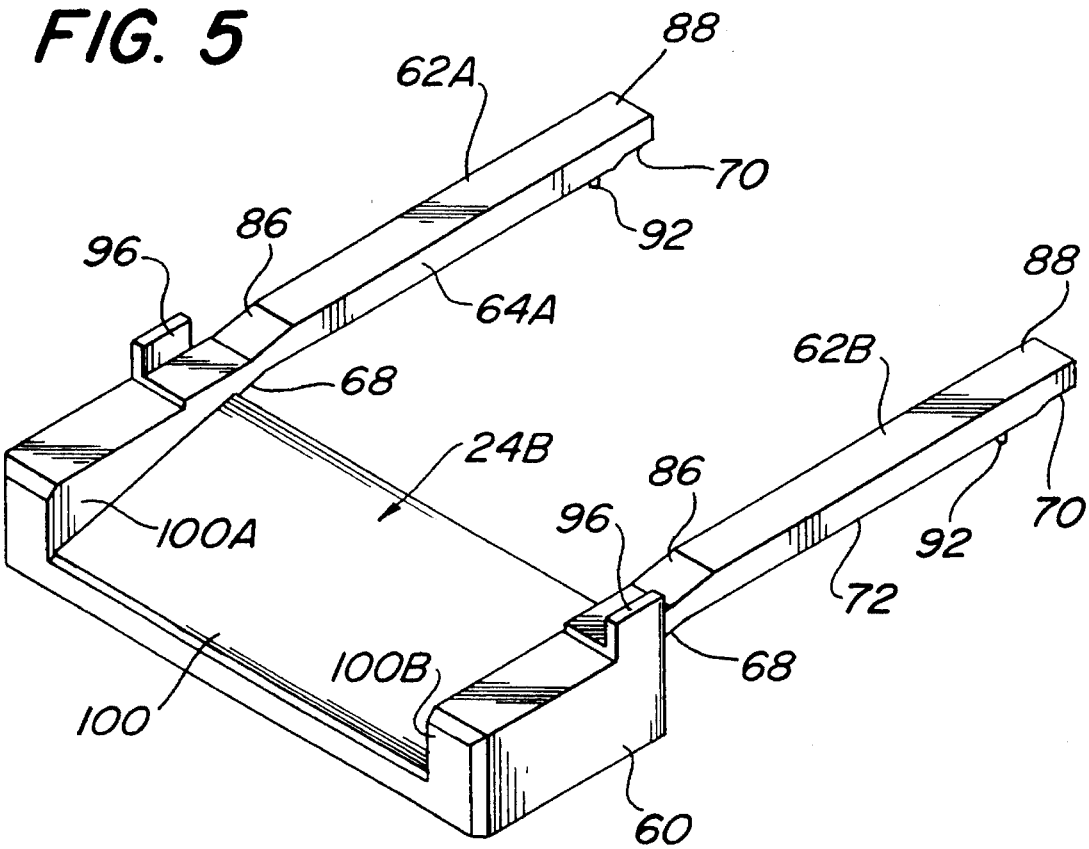
FIG. 5 is an isometric view of an alternative embodiment of a nosepiece for use with the bill or currency acceptor shown in FIG. 1.
Figure 6:
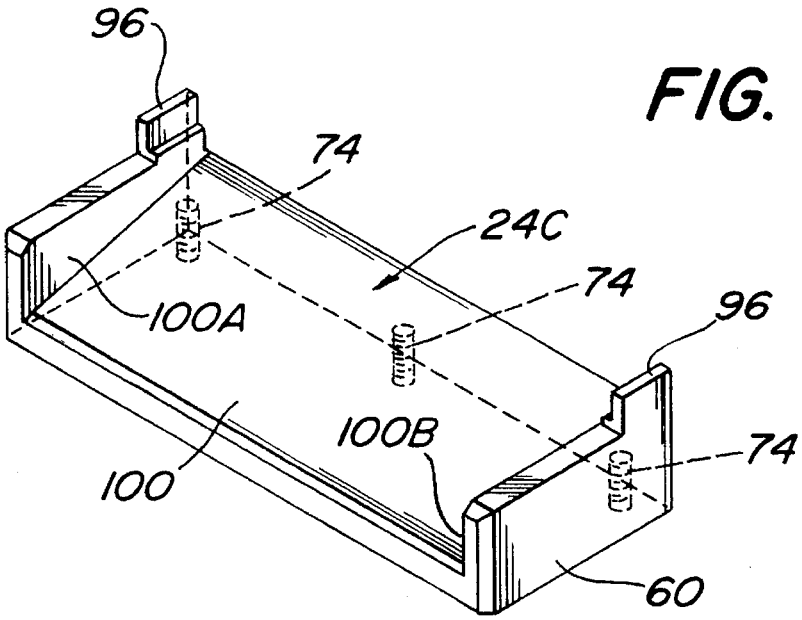
FIG. 6 is an isometric view of yet another alternative embodiment of a nosepiece for use with the bill or currency acceptor shown in FIG. 1.

In FIGS. 5 and 6, there are shown two alternative nose-pieces 24B and 24C constructed in accordance with this invention.

Figure 3:
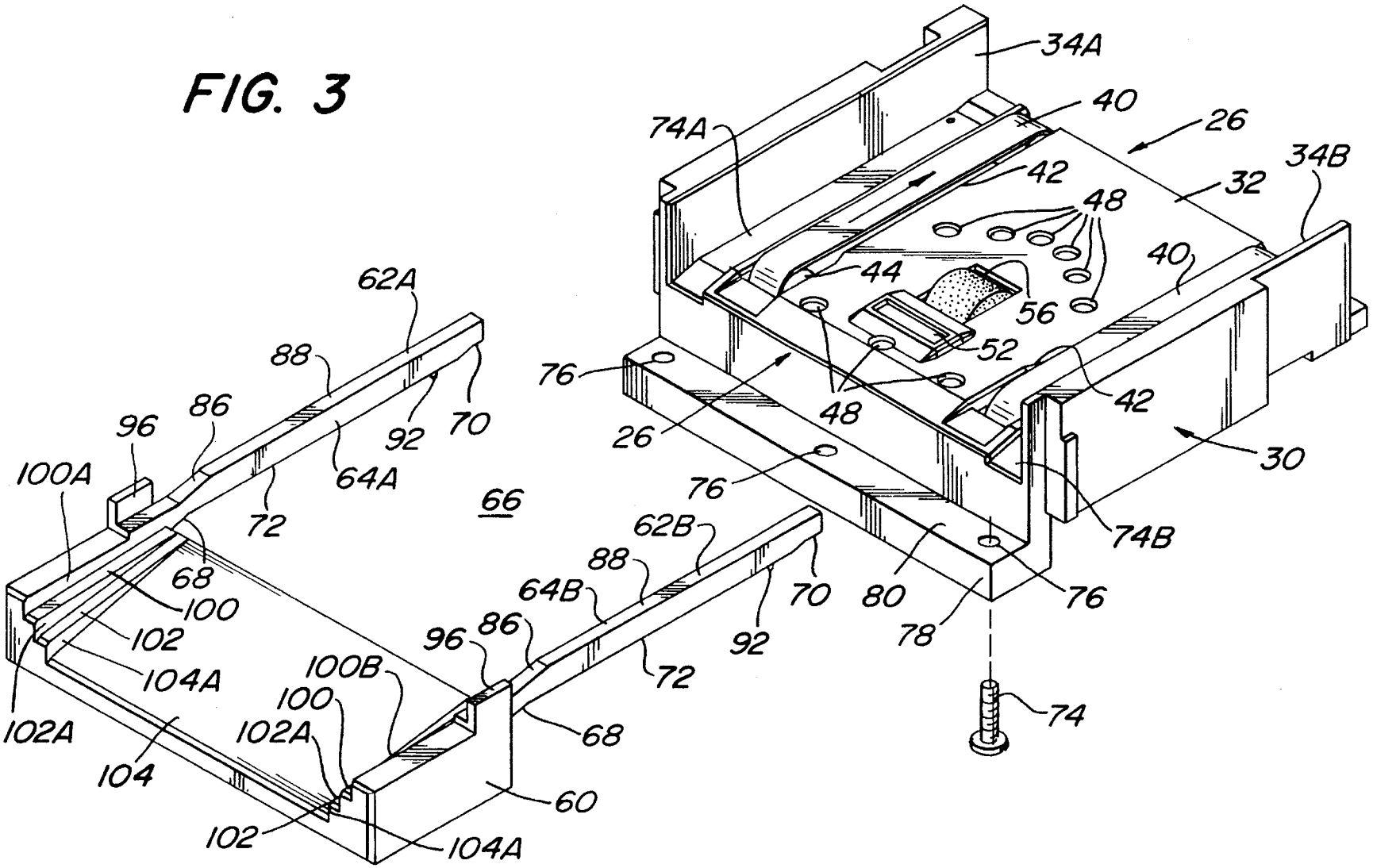
FIG. 3 is an exploded isometric view of one portion, i.e., the nosepiece and the lower plate subassembly, of the bill or currency acceptor embodiment shown in FIG. 1.
Figure 4:
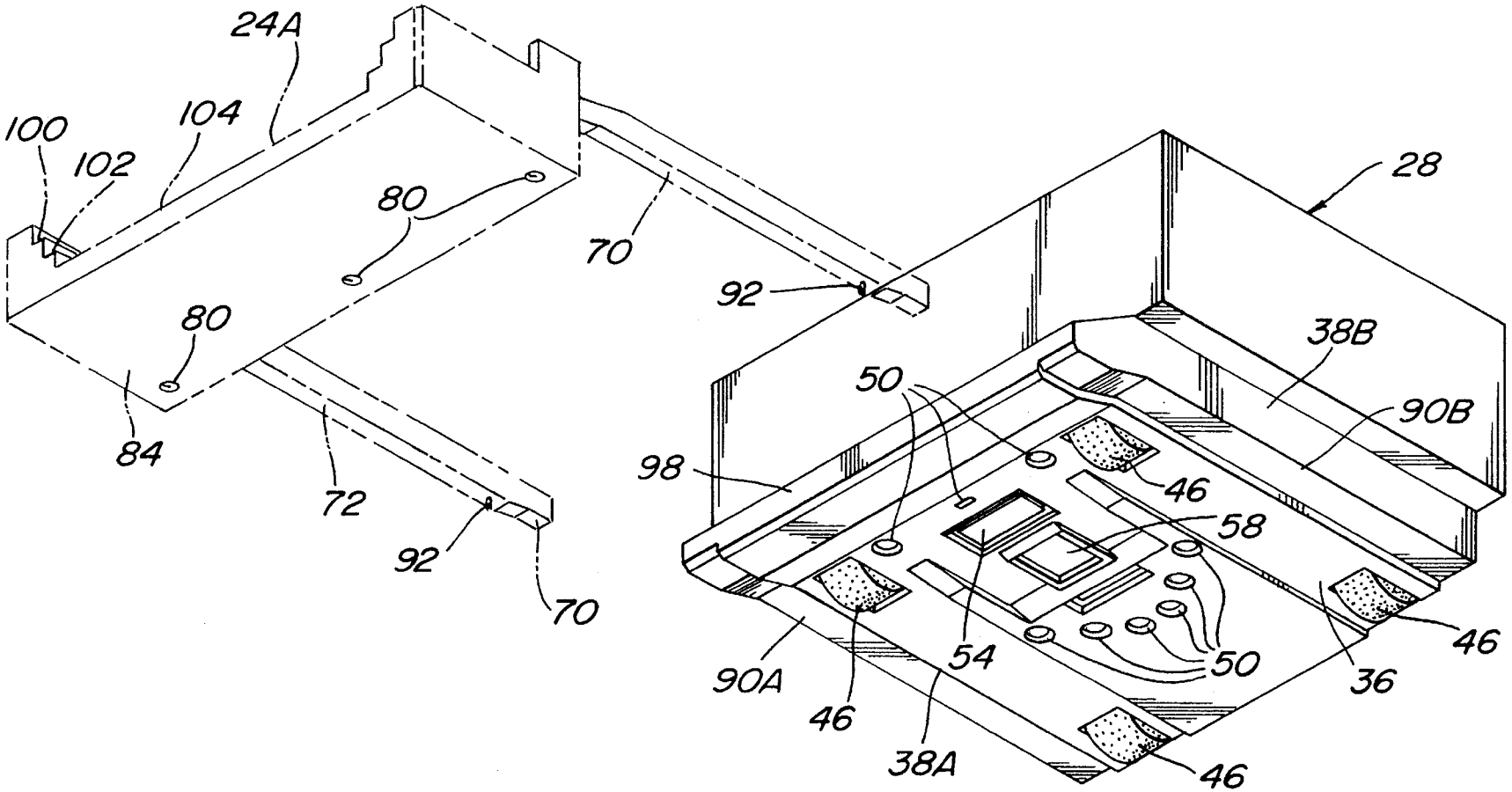
FIG. 4 is an exploded isometric view of another portion, i.e., the nosepiece (shown in phantom lines) and the upper plate subassembly, of the embodiment of the bill or currency acceptor shown in FIG. 1.

Referring again to FIG. 1 it can be seen that the validator unit 22 includes a housing formed of an upper plate subassembly 28 and a lower plate subassembly 30 secured together to define the note transport path 26 therebetween. In particular, as can be seen clearly in FIG. 3, the lower plate subassembly 30 includes a top surface 32 from which pair of side walls 34A and 34B project upward. The side walls 34A and 34B extend along the length of the subassembly from its front to its rear. As can be seen in FIG. 4, the upper plate subassembly 28 includes a bottom surface 36 and a pair of recessed sidewalls 38A and 38B extending along each side of that surface along the entire length of the subassembly from its front to its rear. The spacing between the outer surface of the sidewalls 38A and 38B is the same as the spacing between the inner surface of the upstanding lower plate subassembly sidewalls 34A and 34B so that when the two subassemblies are secured together, the surfaces 34A and 38A abut, as do the surfaces 34B and 38B. The height of the side walls 38A and 38B of the upper plate subassembly is less than the height of the side walls 34A and 34B of the lower plate subassembly, so that when the subassemblies are secured together, via screws (not shown), the bottom surface 36 of the upper plate subassembly is spaced slightly above the upper surface 32 of the lower plate assembly, to establish the height of the paper currency conveying path 26. In particular, the upper surface 32 of the lower plate subassembly 30 forms the bottom surface of the path 26, the lower surface 36 of the upper plate subassembly 28 forms the upper surface of the path 26, and the spacing between the inner surface of the side walls 34A and 34B establishes the width of the path 26. The path extends the full length of validator unit 22, i.e., from its front to its rear.

The conveyor subassembly basically comprises a pair of conveyor belts 40 located on opposite sides of the lower plate subassembly adjacent the side walls 34A and 34B. Each belt is located within a respective recess 42 and extends about a pair of spaced drive pulleys 44. The pulleys are coupled to an electrical motor (not shown) located within the lower plate assembly. Located opposite the pulleys 44 in the upper plate assembly 28 are respective idler rollers 46. The idler rollers 46 are biased to press the note 10 passing through the path 26 into engagement with the belts 40 so that the belts frictionally engage the marginal edges of note to carry it in precise alignment and orientation along the path 26.

The motor is arranged to cause the pulleys 44 to rotate in either the clockwise or counterclockwise direction, depending upon signals from the validator's microprocessor, to drive the exposed portion of the belts 40 either down the path 26 from the front of the validator unit to its rear, or up the path from the rear of the validator to the front. In particular, when a paper currency bill or note is first inserted into the entrance to the path 26 at the front of the validator 22, a sensor detects the presence of the leading edge of the note 10 and provides a signal to the microprocessor, which in turn causes the motor to drive the belts 40 in the direction which pulls the note 10 down the path 26 from the path's entrance past the validator's sensors (to be described later) so that the note can be validated.

After the note 10 is carried past the sensors it is held at an "escrow" position at the rear of the path 26. If the note 10 is determined to be valid, the motor, under the control of the microprocessor restarts to drive the belts in the same direction, and thereby carry the validated note out of the rear of the validator unit to some collection means, e.g., a cash box or receptacle (not shown). If, however, the bill is not validated, the microprocessor provides a signal to the motor to cause it to rotate in the opposite direction, whereupon the belts 40 carry the note from the escrow position back out of the path through its entrance, thereby "rejecting" the note.

The sensors for the validator unit 22 are of generally conventional construction. In particular, as can be seen in FIG. 3, the lower plate subassembly 30 includes nine light emitting diodes (LEDs) 48 (some infrared and some visible light) located in respective openings in the top surface 32 of that subassembly, with three of the LEDs 48 extending along the entrance to the path 26, and with the remaining six LEDs 48 extending in an arc at approximately the middle of the path 26. The operation of the LEDs 48 is controlled by the microprocessor. As can be seen in FIG. 4, the upper plate subassembly 28 includes nine phototransistor sensors 50 located in respective openings in the bottom surface 36 of that subassembly which are aligned with the nine LEDs 48 in the lower plate subassembly when the two are secured together. The phototransistor sensors 50 thus are arranged to receive light from their associated LEDs and to provide output signals indicative of the received light to the microprocessor, as is conventional.

A reflective sensor 52 is located in a mesa extending upward slightly from the top surface 32 of the lower plate subassembly 30 immediately downstream of the central LED 48 at the entrance to the path 26. The reflective sensor 52 is also electrically coupled to the microprocessor. A mirror 54 is located in a recess in the upper plate subassembly which is aligned with the reflective sensor 52 when the two subassemblies are secured together, so that light from the reflective sensor is reflected thereoff and returned to the sensor, which in turn provides an electrical signal indicative of the received light to the microprocessor.

Immediately downstream of the reflective sensor 52 in the lower plate subassembly is a rotatable idler wheel 56. A magnetic head or sensor 58 is located in a recess in the upper plate subassembly and is aligned with the idler wheel 56 when the two subassemblies are secured together. The idler wheel ensures that the bill or note 10 carried through the path 26 is brought into good engagement with the opposed magnetic sensor in order for that sensor to detect magnetic inks on the note being validated.

Referring now to FIGS. 1–4 the details of the entrance port-guiding means, e.g., nose-piece 24A, and the associated features of the validator unit 22 for mounting that nose-piece (and all other nose-pieces of this invention) will now be discussed. As can be seen in FIG. 3. the entrance port means 24A basically comprises a front portion 60 from which a pair of elongated rails 62A and 62B project rearwardly. The inner surfaces 64A and 64B of the rails 62A and 62B, respectively, define a channel 66 therebetween.

The portion of underside surface of each of the rails where it projects from the front portion 60 is in the form of a first ramp surface 68. The portion of the underside surface of each of the rails at its free end is in the form of a second ramp surface 70, while the portion of the underside surface portion 72 of each of the rails between the two ramp surfaces is planar and level. The portion of the top surface of each of the rails 62A and 62B where it projects from the front portion 60 of the nose-piece 24A is also in the form of a first ramp surface 86. The remainder 88 of the top surface of each of the rails is planar and level.

Figure 2:
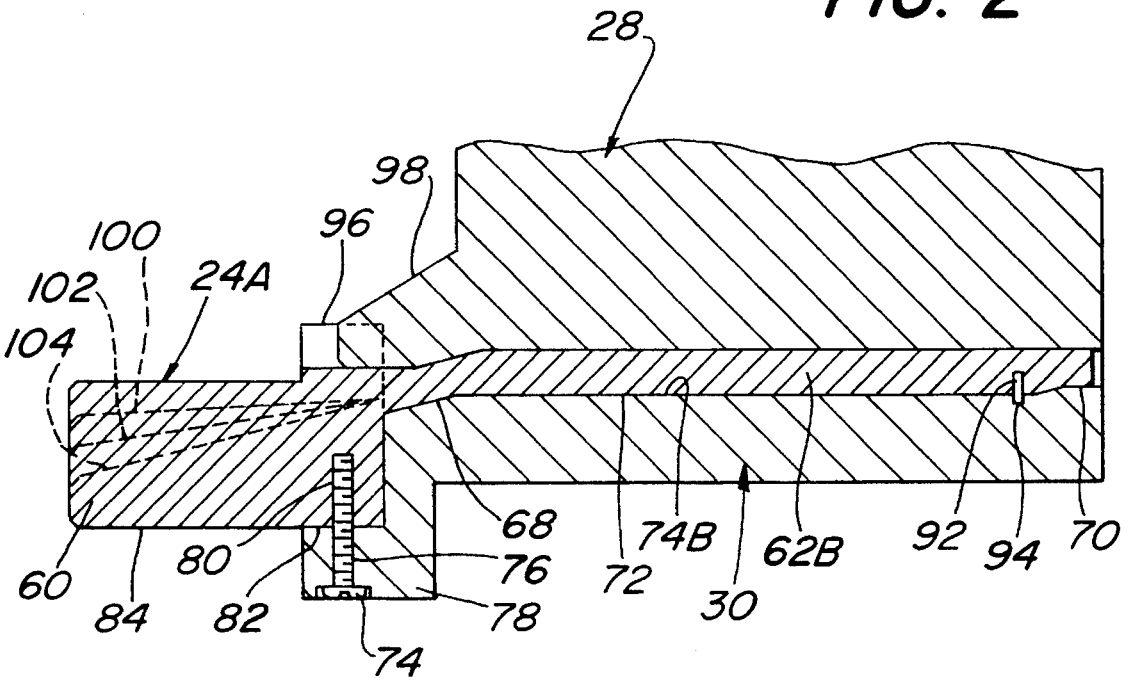
FIG. 2 is an enlarged sectional view taken along line 2—2 of FIG. 1.

The rails 62A and 62B are arranged to be received within correspondingly shaped grooves or recesses, to be described hereinafter, in the lower plate subassembly 30 and in the upper plate subassembly 28. In particular, as can be seen in FIGS. 2 and 3 a pair of recess 74A and 74B are provided in the lower plate subassembly 30. The recesses 74A and 74B extend along the path contiguous with the inner surfaces of the side walls 34A and 34B, respectively, and are arranged to receive the undersurface of the rails 62A and 62B therein. As can be seen clearly in FIGS. 2 and 4 the rails 62A and 62B are arranged to be received within correspondingly shaped grooves or recesses 90A and 90B, respectively, in the upper plate subassembly 30. These recesses extend along the path contiguous with the inner surfaces of the side walls 38A and 38B, respectively.

The nose-piece 24A is arranged to be releasable secured or mounted to the lower plate subassembly 30 via plural mounting screws 74 (only one of which can be seen) extending through respective holes 76 in a ledge 78 projecting from the front of the subassembly and into threaded holes 80 in the bottom of the front portion 60 of the nose-piece. The ledge 78 includes a top surface 82 on which the undersurface 84 of the front portion 60 of the nose-piece 24A rests, as shown clearly in FIG. 2 when the screws are tightened. Thus, when the two subassemblies 28 and 30 are secured together the rails 62A and 62B of the nose-piece 24A are interposed between those two subassemblies.

In order to expedite the longitudinal positioning of the rails between the plate subassemblies, each rail optionally includes a downwardly projecting locator pin 92 for receipt in a respective small bore 94 in the lower plate subassembly (see FIG. 2).

A pair of flanges 96 extend upward from either side of the front portion 60 of the nose-piece 24A. These flanges are arranged to engage the side surfaces of an overhanging projection 98 on the upper plate subassembly 28. The overhanging projection serves as a roof for the entrance to the path 26 through the acceptor 20, while a ramp surface 100 (to be described later) serves as the floor for the entrance to the path 26.

It should be pointed out at this juncture that the nose-piece 24A shown in FIGS. 1–4 is particularly suited for applications wherein the acceptor device 20 will be called upon to validate paper currency of plural, predetermined known widths, e.g., German Deutschmarks. Thus, that nose piece includes additional ramp surfaces (to be described later) in addition to ramp surface 100 in order to center each particular size currency note into the path 26 of the acceptor device.

In the interests of clarity and for ease of understanding of the subject invention, before discussing the multiple size note accommodation aspect of the nose-piece 24A of this invention, a description of a nose-piece for use with only a single size of paper currency, e.g., U.S. currency, is in order. To that end, attention should now be directed to FIG. 5 wherein a nose-piece 24B designed to be used for applications wherein only a single size of currency note or bill will be presented to the acceptor, e.g., United States Dollars, is shown. As can be seen therein nose-piece 24B is identical in construction to nose-piece 24A except for the fact that its rails 62A and 62B are slightly wider, and that it only includes one ramp surface, namely, ramp surface 100. Moreover, the nose-piece 24B is releasably mounted to the validator unit 22 in the same manner as described with reference to the nose-piece 24A. Further still, in the interests of brevity the common details of the nose-pieces 24A and 24B and their function will not be reiterated, and the same reference numerals will be given for like features of those two nose-pieces.

Thus, as can be seen in FIG. 5 the front portion 60 of the nose-piece 24B includes a single ramp surface 100. The width of the ramp surface, i.e., the spacing between its side surfaces 100A and 100B, is the same as the width of the channel 66 formed between the rails 62A and 62B. With the nose-piece 24B mounted on the validator 22 as described above the maximum width of the path 26 that a paper bill or note 10 can take through the validator unit 22 is established by the width of the channel 66, i.e., the spacing between the inside surfaces 64A and 64B of the rails 62A and 62B. For U.S. currency the spacing between the rails 62A and 62B of a preferred embodiment of a nose-piece of this invention is 67 mm. The maximum possible width of the path 26, i.e., the spacing between the side surfaces of the side walls 34A and 34B in a preferred embodiment of the validator unit 22, is 82 mm.

As should be appreciated from the foregoing, when a U.S. currency bill or note is slid up the ramp surface 100 between the side surfaces 100A and 100B it is initially aligned and oriented thereby so that its central longitudinal axis is coaxial with the central longitudinal axis of the path 26. The side surfaces 64A and 64B of the rails which are flush with the surfaces 100A and 100B, respectively, maintain this alignment and orientation of the bill or note 10 as it is carried by the belts 40 down the path 26 past the sensors for proper validation.

If it is desired to configure the acceptor device 20 to accommodate paper currency of a width less than that of U.S. currency, all that is required is to partially disassembly the validator unit, i.e., disconnect the two plate subassemblies 28 and 30 from each other and disconnect the nose piece 24A from the lower plate subassembly. Another nose-piece, this one having a ramp surface 100 with sidewalls 100A and 100B and associated side rails 62A and 62B, respectively, of the desired smaller width, is then mounted between the upper and lower plate subassemblies and those subassemblies reconnected together. The bill acceptor 20 is now ready to validate narrower width paper currency. In a similar manner if it is desired to configure the acceptor device 20 to accommodate paper currency of a width greater than that of U.S. currency, all that is required is to partially disassembly the validator unit 22, i.e., disconnect the two plate subassemblies 28 and 30 from each other and disconnect the nose piece 24A from the lower plate subassembly. Another nose-piece, this one having a ramp surface with sidewalls 100A and 100B and associated side rails 62A and 62B, respectively, of the desired greater width, is then mounted between the upper and lower plate subassemblies and those subassemblies reconnected together. The bill acceptor 20 is now ready to validate wider width paper currency.

It should be pointed out at this juncture that while it is desirable that the nose-pieces constructed in accordance with this invention include side rails 62A and 62B, such a construction is not mandatory, since the side surfaces 102A and 102B of the ramp surface 100 effects the initial alignment and orientation of the bill to the conveyor belts. One such alternative nose-piece is shown in FIG. 6 and is designated by the reference number 24C. That nose-piece is identical in construction to the nose-piece 24B, except that it does not include the rails 62A and 62B and is of the largest width, e.g., 82 mm. Thus, the same reference numbers will be given for the identical features of the nose-piece 24C to those given with respect to the nose-piece 24B. The width of the channel formed by the nose piece is as wide as the path 26 itself so that rails are unnecessary. The nose-piece 24C is mounted on the validator unit 22 in a similar manner as described earlier, by i.e., the support ledge 78 supporting the undersurface 84 of the nose-piece's front portion 60 thereon, with the screws securing the nose-piece in place.

As should be appreciated by those skilled in the art with the nose-piece 24C mounted on the validator unit 22, if the validator's belts are sufficiently wide, such as shown in FIG. 3, and extend parallel to the central longitudinal axis of the path 26, the bill inserted through the nose-piece 24C should not become misaligned or misoriented as it is carried by the belts down the path past the sensors. Use of guide rails in a nose-piece, however, ensures that the bill or note cannot become misaligned as it is carried by the conveyor belts down the path.

As should also be appreciated by those skilled in the art the validator unit 22 can be utilized with paper currency having a width up to the maximum width of the path 26 through the validator, i.e., the spacing between the side walls 34A and 34B.

Returning now to FIGS. 1–4, the multiple currency size handling ability of the nose-piece 24A will now be described. Thus, as can be seen the nose-piece 24A includes two other ramp surfaces 102 and 104 in addition to ramp surface 100. The inner surface of the side walls defining the ramp surface 102 are denoted by the reference numbers 102A and 102B, and define the width of another, small width, paper bill or note to be validated by the acceptor 20. The inner surface of the side walls defining the ramp surface 104 are denoted by the reference numbers 104A and 104B, and define the width of yet another, even smaller width, paper bill or note to be validated by the acceptor 20.

Use of the nose-piece 24A for the widest paper currency to be validated is as follows: The currency note is disposed on the ramp surface 100 between the side walls 100A and 100B and guided into the path 26, whereupon the belts 40 carry the properly aligned and oriented bill down the path past the sensors. The guide rails 62A and 62B ensure that the bill or note does not become misaligned during its passage past the sensors. When it is desired to validate a note of intermediate width, that note is disposed on the ramp surface 102 between the side walls 102A and 102B and guided into the path 26, whereupon the belts 40 carry the properly aligned and oriented bill down the path past the sensors. When it is desired to validate a note of the narrowest width, that note is disposed on the ramp surface 104 between the side walls 104A and 104B and guided into the path 26, whereupon the belts 40 carry the properly aligned and oriented bill down the path past the sensors.

As should be appreciated from the foregoing the use of a bill or note validator unit constructed in accordance with this invention has universal applicability since it can be readily configured to accommodate any width paper currency by the appropriate selection and mounting of a nose-piece constructed in accordance with this invention. Thus, it is no longer necessary to manufacture different size note acceptors for each different size paper currency note to be handled thereby.

Without further elaboration the foregoing will so fully illustrate our invention that others may, by applying current or future knowledge, adapt the same for use under various conditions of service.

We claim:

1. A note acceptor for validating a paper currency note introduced therein, said acceptor being arranged to accept a first paper currency note and a second, paper currency note, said second paper currency note being larger in width than said first paper currency note, said acceptor comprising a validator unit and at least a first entrance port means for guiding said first paper currency note to said validator, said validator unit comprising a housing, conveying means, and sensor means, said housing having a pair of spaced apart internal surfaces defining a path therebetween, said path extending through said validator unit and being arranged to have either the first or second paper currency notes conveyed therethrough, said path being of a width sufficient to accommodate the second paper currency note, said sensor means being disposed adjacent said path to sense either the first or the second paper currency note, said conveying means being disposed within said housing adjacent said path to convey either the first or the second paper currency note to said sensor means for sensing thereby, said first entrance port means being releasably secured to said housing to form the entrance to said path and comprising a front portion from which a pair of elongated rails project rearwardly, said front portion being located outside said housing with said rails extending substantially into said housing along said path when said first entrance port means is releasably secured to said housing, said elongated rails defining therebetween a first channel of a first predetermined width corresponding to the width of the first paper currency note, whereupon when the first paper currency note is inserted into said channel said channel guides the first paper currency note to said conveying means, which in turn conveys the first paper currency note in proper alignment and orientation to said sensor means, said validator unit being arranged to accept the second paper currency note when the first entrance port means is removed from said housing, whereupon the second paper currency note is guided through said path by said spaced apart internal surfaces of said validator unit.

2. The note acceptor of claim 1 additionally comprising second entrance port means adapted to be releasably secured to said validator unit to guide a third paper currency note into said validator unit, said third paper currency note being narrower than said first paper currency note, said third entrance port means comprises a front portion from which a pair of rails project rearwardly, said pair of rails defining a third channel therebetween, said third channel being of the width of said third paper currency note, whereupon when the third paper currency note is inserted into said third channel said third channel guides the third paper currency note to said conveying means, which in turn conveys the third paper currency note to said sensor means in a desired alignment and orientation.

3. The note acceptor of claim 1 wherein said front portion includes a ramp surface disposed between a pair of side surfaces, said side surfaces being aligned with respective ones of said rails.

4. The note acceptor of claim 1 additionally comprising second entrance port means for releasable securement to said validator unit to replace said first entrance port means as the entrance to said path, said second entrance port means defining a second channel of a second predetermined width corresponding to the width of the second paper currency note, whereupon when the second paper currency note is inserted into said second channel said second channel guides the second paper currency note to said conveying means, which in turn conveys the second paper currency note to said sensor means in a desired alignment and orientation.

5. The note acceptor of claim 4 wherein said second entrance port means comprises a ramp surface disposed between a pair of side surfaces, said ramp surface being of the same width as said second channel.

6. The note acceptor of claim 1 wherein said first entrance port means defines said first channel and a third channel said third channel being of a width corresponding to the width of a third paper currency note which is narrower than the first paper currency note, whereupon when the first paper currency note is inserted into said first channel said first channel guides the first paper currency note to said conveying means, which in turn conveys the first paper currency note in a desired alignment and orientation to said sensor means, and whereupon when the third paper currency note is inserted into said third channel said third channel guides the third paper currency note to said conveying means which in turn conveys the third paper currency note in a desired alignment and orientation to said sensor means.

7. The note acceptor of claim 6 wherein said front portion includes respective ramp surfaces aligned with said first and third channels, each of said ramp surfaces disposed between respective pairs of side surfaces.

* * * * *